US009251973B2

(12) United States Patent
Matsubara et al.

(10) Patent No.: US 9,251,973 B2
(45) Date of Patent: Feb. 2, 2016

(54) PUSH BUTTON SWITCH AND ELECTRONIC APPARATUS USING SAME

(71) Applicant: OMRON Corporation, Kyoto-shi, Kyoto (JP)

(72) Inventors: Junichi Matsubara, Fukuchiyama (JP); Makoto Kasuya, Ayabe (JP)

(73) Assignee: OMRON Corporation, Kyoto-shi (JP)

( * ) Notice: Subject to any disclaimer, the term of this patent is extended or adjusted under 35 U.S.C. 154(b) by 115 days.

(21) Appl. No.: 14/087,103

(22) Filed: Nov. 22, 2013

(65) Prior Publication Data

US 2014/0090968 A1 Apr. 3, 2014

Related U.S. Application Data

(63) Continuation of application No. PCT/JP2012/074182, filed on Sep. 21, 2012.

(30) Foreign Application Priority Data

Oct. 14, 2011 (JP) ..... 2011-226667

(51) Int. Cl.
*H01H 13/14* (2006.01)
*H01H 13/85* (2006.01)
(Continued)

(52) U.S. Cl.
CPC ..... *H01H 13/14* (2013.01); *H01H 13/186* (2013.01); *H01H 13/85* (2013.01); *H01H 21/00* (2013.01); *H01H 23/145* (2013.01)

(58) Field of Classification Search
CPC ..... H01H 2221/016; H01H 2003/466; H01H 13/186; H01H 23/145
USPC ..... 200/530, 343, 341
See application file for complete search history.

(56) References Cited

U.S. PATENT DOCUMENTS 5,087,802 A * 2/1992 Guilleminot ..... 200/343
5,165,531 A * 11/1992 Kawakami et al. ..... 200/343
(Continued)

FOREIGN PATENT DOCUMENTS

JP H11-224560 A 8/1999
JP 2002-025391 A 1/2002
(Continued)

OTHER PUBLICATIONS

Extended European search report searched on Mar. 12, 2015 in the counterpart European patent application.

*Primary Examiner* — Edwin A. Leon
*Assistant Examiner* — Ahmed Saeed
(74) *Attorney, Agent, or Firm* — Marvin A. Motsenbocker; Mots Law, PLLC

(57) ABSTRACT

A switch includes a switch main body having a movable section displaceable downward by pressure to bring a movable contact into contact with a fixed contact, the movable section being displaced upward to open each contact by a release of pressure; a button section that presses the movable section in response to a downward pressing operation; and a support arm having one end portion supporting the button section. An end of the support arm not coupled to the button section is turnable and held at a location in a support surface arranged vertically. The button section bottom surface is inclined and separated from the movable section when the button section is not pressed. When the button section is pressed and is lowered to a position at which the fixed contact and the movable contact are closed, the bottom surface is in an approximately horizontal state and presses the movable section.

6 Claims, 8 Drawing Sheets

(51) Int. Cl.

| | |
|---|---|
| ***H01H 13/18*** | (2006.01) |
| ***H01H 21/00*** | (2006.01) |
| ***H01H 23/14*** | (2006.01) |

(56) References Cited

U.S. PATENT DOCUMENTS

| | | | | |
|---|---|---|---|---|
| 5,898,141 | A * | 4/1999 | Blalock et al. | 200/5 A |
| 5,914,468 | A * | 6/1999 | Nishimura et al. | 200/5 A |
| 6,031,196 | A * | 2/2000 | Johnston | 200/343 |
| 6,940,030 | B2 * | 9/2005 | Takeda et al. | 200/343 |
| 7,005,588 | B2 * | 2/2006 | Pihlaja | 200/5 A |
| 2008/0190750 | A1 * | 8/2008 | Plesko et al. | 200/343 |
| 2012/0292167 | A1 * | 11/2012 | Hirota | 200/343 |
| 2014/0083830 | A1 * | 3/2014 | Sawada et al. | 200/343 |

FOREIGN PATENT DOCUMENTS

| | | | |
|---|---|---|---|
| JP | 2002-056738 | A | 2/2002 |
| JP | 2004-101446 | A | 4/2004 |
| JP | 2006-155996 | A | 6/2006 |
| JP | 2011-003472 | A | 1/2011 |

* cited by examiner

PUSH BUTTON SWITCH AND ELECTRONIC APPARATUS USING SAME

CROSS REFERENCE TO RELATED APPLICATIONS

This application is a Continuation of PCT Application No. PCT/JP2012/074182 filed on Sep. 21, 2012, and claims the priority of Japanese Patent Application No. 2011-226667 filed on Oct. 14, 2011, the entire contents of which are incorporated herein by reference.

TECHNICAL FIELD

The present invention relates to a push button switch that operates in response to a pressing operation and an electronic apparatus including an operating section to which the push button switch is introduced.

BACKGROUND ART

There is a general push button switch including a movable section in which a movable contact is provided in a lower end portion and a button section that presses the movable section. The movable section is disposed on a fixed contact provided on a circuit board while opposed to the fixed contact, and the button section is exposed from a surface of a casing. When a user presses the button section downward with a finger, both the button section and the movable section are disposed downward, and the movable contact and the fixed contact come into contact with each other. When the user separates the finger from the button section, the button section and the movable section return to original positions to release a contact state of each contact (see Patent Document 1).

Recently, the push button switches suitable to various compact electronic apparatuses are developed, and sometimes the plurality of push button switches are disposed in a top portion of the narrow casing (see Patent Document 2). Sometimes the push button switch having a configuration in FIG. 8 is used, because a control board is accommodated in the electronic apparatus while standing up.

In the example in FIG. 8, a push button switch SW0 includes a switch main body 1 including a movable section 10 that is vertically movable, a button section 2 pressing the movable section 10 in response to a downward pressing operation, and a support arm 3 integral with the button section 2. A rear surface of the switch main body 1 is fixed to one (background portion in FIG. 8) of surfaces of a board that is disposed in the standing state, and a leading end of the support arm 3 is also attached to the identical surface of the board such that the support arm 3 is turnable.

As illustrated in FIG. 8(1), when the downward pressing operation is not performed, the button section 2 is supported so as to be slightly separated from the movable section 10. As illustrated in FIG. 8(2), when the button section 2 is subjected to a pressure of the downward pressing operation, the support arm 3 and the button section 2 rotate about the leading end of the support arm 3, the leading end being attached to the board, and the button section 2 presses the movable section 10 while obliquely inclined.

PRIOR ART DOCUMENT

Patent Documents

Patent Document 1: Japanese Unexamined Patent Publication No. 2002-56738

Patent Document 2: Japanese Unexamined Patent Publication No. 2004-101446

SUMMARY

Problems to be Solved by the Invention

When the user presses the push button switch downward, desirably a sufficient click feeling (a response at the press of the button) is provided to the user.

FIG. 9 illustrates a curve (an FS curve) expressing a reaction force F from the movable section in association with the downward pressing operation of the push button switch and a stroke amount S of the movable section. The reaction force increases gradually immediately after the movable section starts to movement, and the reaction force decreases rapidly while the movable section passes through (between S1 and S2 in FIG. 9) a level (hereinafter referred to as an on point) at which a variable contact and the fixed contact come into contact with each other. Then the reaction force increases again. The click feeling is generated by switching of the decrease or increase in reaction force. When the movable section is obliquely pressed like the example in FIG. 8(2), the click feeling decreases, a gradient of the change in reaction force becomes moderate and the click feeling decreases.

In the configuration in FIG. 8, in order to improve the click feeling, it is necessary to press the movable section 10 passing through the on point from a direction close to a perpendicular direction. Therefore, it is necessary that the bottom surface of the button section 2 be not inclined as much as possible. In other words, it is necessary to move the button section 2 to the level identical to that in FIG. 8(2) with the smallest possible rotation angle. However, a space necessary to install the switch SW0 is enlarged, because the support arm 3 is lengthened to secure the equal stroke amount with the small rotating angle. Therefore, there is a risk of generating a trouble when the switch SW0 is introduced to the compact electronic apparatus having the restricted size of the operating section.

A method, in which the push button switch having the configuration disclosed in Patent Document 1 is introduced while a board dedicated to the switch is horizontally disposed below an upper surface of the casing, is conceivable as another method for securing the click feeling. However, in the method, two boards are required, and man-hour increases due to electric connection between the boards and the like, which results in cost increase.

An object of the present invention to provide a push button switch that improves the click feeling without increasing the installation space or the cost.

Means for Solving the Problem

In accordance with one aspect of the present invention, a push button switch includes: a switch main body including a movable section configured to be displaced downward by a pressure to bring a movable contact into contact with a fixed contact, the movable section being configured to be displaced upward to open each contact by a release of the pressure; a button section configured to press an upper surface of the movable section in response to a downward pressing operation; and a support arm in which one of end portions is coupled to a button section, and the other end portion is attached to a support surface provided along a vertical direction such that the support arm is turnable, the support arm supporting the button section that is not subjected to the downward pressing operation so as to separate the button section from the movable section. In the push button switch, the end portion of the support arm in the side not coupled to the button section is attached to the support surface while positioned laterally or obliquely downward with respect to a moving range of an upper surface of the movable section. An inclination angle of a bottom surface of the button section is set such that the bottom surface constitutes an inclination surface while being not subjected to the downward pressing operation, and such that the bottom surface becomes substantially horizontal when the movable section is pressed to a position where the movable contact and the fixed contact are brought into contact with each other.

According to the above configuration, before the downward pressing operation, the button section is supported while the bottom surface of the button section is inclined. When the downward pressing operation is performed, because the button section and the support arm rotate about the end portion of the support arm in the side not coupled to the button section, the button section lowers while gradually decreasing the gap with the movable section, and the button section presses the movable section. When the movable section lowers close to the level (the on point) at which the movable contact and the fixed contact are brought into contact with each other, the bottom surface of the button section pressing the movable section becomes substantially horizontal, so that the movable section passing through the on point can be pressed from the substantially perpendicular direction. Therefore, the user who performs the downward pressing operation can feel the sufficient click feeling.

In one embodiment of the push button switch having the above configuration, the inclination angle of the bottom surface of the button section is set so as to be an angle $\phi$ that falls within a predetermined error range with respect to an angle $\theta$ that is formed between a straight line connecting a center (point B described below) of the upper surface of the movable section that lowers to the position where the movable contact and the fixed contact are brought into contact with each other and a position that constitutes a rotation axis of the support arm and a straight line connecting a center of the bottom surface of the button section that is not subjected to the downward pressing operation and the position that constitutes the rotation axis of the support arm. In more restricted embodiment, the inclination angle of the bottom surface of the button section is set to the error range between −3 degrees to +3 degrees with respect to the angle $\theta$.

According to the embodiments, the difference between the inclination of the bottom surface of the button section and the horizontal direction can be lessened when the button section and the support arm rotate by the angle $\theta$.

In the push button switch having the above configuration, one surface except an upper surface and a lower surface of the switch main body and the end portion of the support arm in the side not coupled to the button section are attached to the support surface (for example, one of the surface of the board that is disposed in the casing while standing up or the inner wall surface of the casing) in the casing, and the button section can be disposed while exposed from the surface of the casing. According to the configuration, the pressure can be applied from the direction substantially perpendicular to the movable section passing through the on point without lengthening the support arm. Therefore, the push button switch having the good operability can be disposed in the compact electronic apparatus having a small margin of the installation space.

Effect of the Invention

According to the present invention, the click feeling can be improved without increasing the installation space or the cost in the push button switch attached to the support surface along the vertical direction.

DETAILED DESCRIPTION

Figure 1:
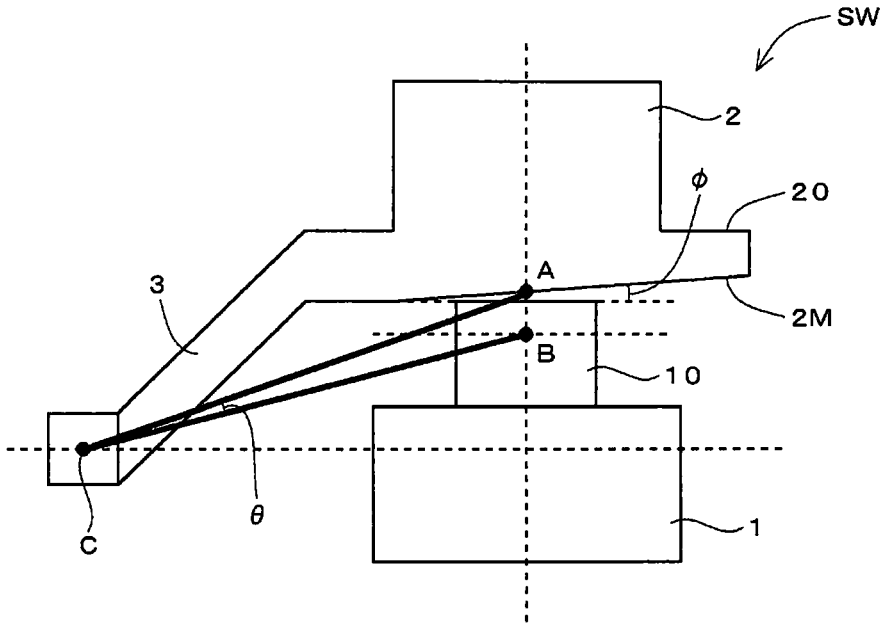
FIG. 1 is a schematic view illustrating a configuration of a push button switch to which the present invention is applied.

FIG. 1 is a schematic view illustrating a configuration of a push button switch to which the present invention is applied. A push button switch SW according to an embodiment is constructed by a switch main body 1 that includes a movable section 10 projecting upward, a button section 2 that presses the movable section 10, and a support arm 3 that supports the button section 2. A rear surface of the switch main body 1 and one end portion of the support arm 3 are attached to one (a background portion in the drawings) of surfaces of a control board that is dispose in a standing state.

A fixed contact (not illustrated) is disposed in the switch main body 1, and a movable contact (not illustrated) is disposed in a lower end portion of the movable section 10. The movable section 10 is supported by an elastic member (not illustrated) and the like while being vertically movable in the switch main body 1, and the movable contact and the fixed contact come into contact with each other when an upper surface of the switch main body 1 lowers at a level of a point B in the drawings.

The button section 2 and the support arm 3 are integrally formed. The button section 2 has a shape in which a flange section 20 is integrally provided in a bottom portion of a cubic main body, and one side of the flange section 20 is coupled to the support arm 3. The flange section 20 is sufficiently larger than the switch main body 1, and a thickness of the flange section 20 decreases gradually from the side coupled to the support arm 3 toward an opposite side. A bottom surface 2M of the button section 2 constitutes an incline surface, which is displaced obliquely upward from the side coupled to the support arm 3 toward the opposite side, by the change in thickness of the flange section 20.

The support arm 3 is turnably supported at a position slightly lower than a moving range of the upper surface of the switch main body 1 while being a predetermined distance away from the switch main body 1. The button section 2 is supported in a horizontal posture by the support arm 3 while the bottom surface in a portion (the outside of the switch main body), which is close to the support arm 3, of the flange section 20 is adjusted to the level of the upper surface of the movable section 10. At this point, a gap is formed between the button section 2 and the movable section 10 according to an inclination angle ϕ of the bottom surface 2M of the button section 2. When the user presses the button section 2 with the finger, the button section 2 and the support arm 3 rotate about the position where the support arm 3 is attached, and the gap is gradually narrowed to press the movable section 10.

A point A in the drawings indicates a center position of the bottom surface 2M of the button section 2 when the button section 2 is not subjected to the downward pressing operation, and the point B indicates a center position (corresponding to the "on point") of the upper surface of the movable section 10 when the movable contact and the fixed contact come into contact with each other. A point C corresponds to the position of the rotation axis of the support arm 3.

The inclination angle ϕ of the bottom surface 2M of the button section 2 is set to an angle close to an angle θ in the drawings.

The angle θ is formed between a line segment AC connecting the point A and the point C and a line segment BC connecting the point B and the point C. When the support arm 3 rotates by the angle θ about the point C, the button section 2 coupled to the support arm 3 also becomes the posture in which the button section 2 inclines by the angle θ, and the bottom surface 2M including the point A lowers close to the level of the point B. The upper surface of the movable section 10 pressed by the button section 2 also lowers close to the level of the point B.

When the inclination angle ϕ of the bottom surface 2M of the button section 2 is set to a value close to the angle θ before the pressing operation, the bottom surface 2M of the button section 2, which inclines by the angle θ, becomes substantially horizontal, and the movable section 10 located immediately below can be pressed from the substantially perpendicular direction. Therefore, a curve of a change in reaction force from the movable section 10 becomes steep, and the sufficient click feeling can be provided to the user who performs the downward pressing operation.

Figure 2:
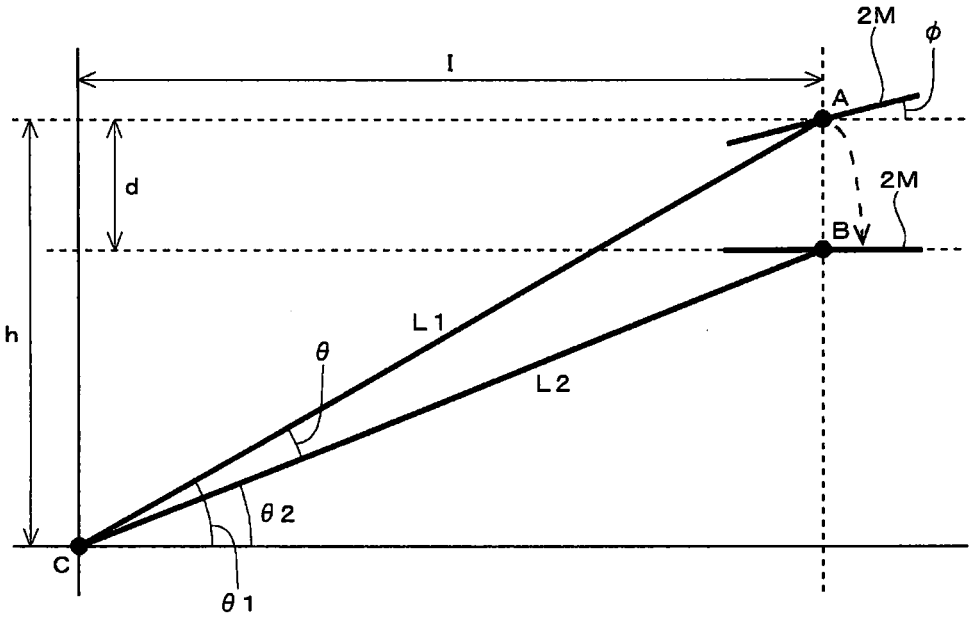
FIG. 2 is a schematic view illustrating a relationship among points A, B, and C in FIG. 1 and angles $\theta$ and $\phi$.

FIG. 2 illustrates a relationship among the points A indicating the center position of the bottom surface 2M of the button section 2, the point B indicating the on point of the movable section 10, the point C indicating the position of the rotation axis of the support arm 3, and the angles θ and ϕ. FIG. 2 illustrates the inclination of the bottom surface 2M of the button section using an extra-thick line together with the line segment AC and the line segment BC.

In FIG. 2, d is a difference in level between the points A and B, h is a difference in level between the points A and C, I is a distance from the point C to a center line of the switch main body 1, L1 is a length of the line segment AC, and L2 is a length of the line segment BC. Angles θ1 and θ2, which are formed by the line segment AC and the line segment BC with respect to the horizontal direction, can be calculated by the following equations using theses parameters.

[Mathematical formula 1]

$$\theta 1 = \sin^{-1}\frac{h}{L1} = \sin^{-1}\frac{h}{\sqrt{I^2 + h^2}}$$

-continued $$\theta 2 = \sin^{-1}\frac{(h-d)}{L2} = \sin^{1}\frac{(h-d)}{\sqrt{I^2 + (h-d)^2}}$$

The angle θ can be obtained by performing a calculation of θ=θ1−θ2 using the angles θ1 and θ2 obtained from the above equations.

Accordingly, when the positions of the points A, B, and C are determined in designing the switch, the angle θ can be calculated from the above relationship. When a difference between the angle θ and the inclination angle ϕ of the bottom surface 2M of the button section 2 falls within a predetermined error range, the movable section 10 can be pressed from the pressing direction, which is considered to be required for the securement of the click feeling, even in the neighborhood of the on point.

An experiment performed by the inventors shows that the click feeling is not degraded when a difference in angle between the pressing direction toward the movable section 10 and the perpendicular direction falls within the range of ±3 degrees. Accordingly, it is considered that the angle ϕ is desirably determined within the range of ϕ=θ±3 degrees.

Figure 3:
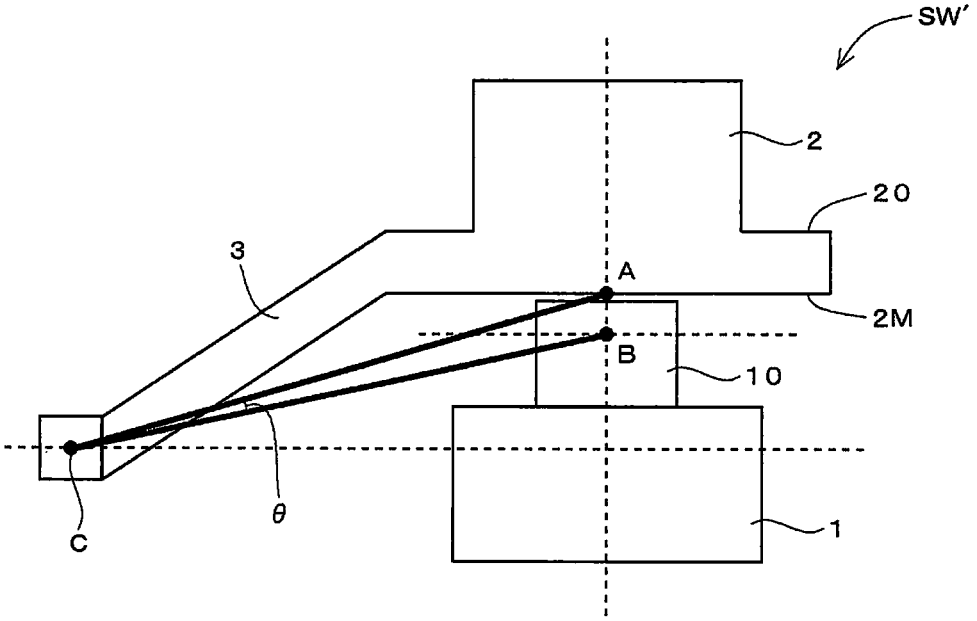
FIG. 3 is a schematic view illustrating a configuration of a push button switch that secures a click feeling without applying the present invention.

In FIG. 3, a switch SW', which is designed such that the click feeling can be secured without inclining the bottom surface 2M of the button section 2, will be described in order to explain an advantage obtained by inclining the bottom surface 2M of the button section 2. For the sake of easy contrast, each component of the switch SW' is designated by the identical symbol in FIG. 1.

When the bottom surface 2M of the button section 2 that is not subjected to the pressing operation is leveled, the bottom surface 2M of the button section 2 becomes the inclined state as the bottom surface 2M rotates together with the support arm 3 according to the pressing operation. According to the above experimental result, it is necessary that the difference in angle between the pressing direction toward the movable section 10 and the perpendicular direction fall within 3 degrees in order to secure the click feeling. Therefore, it is necessary that the rotation angle θ (the angle formed by the line segment AB and the line segment BC) necessary to displace the bottom surface 2M of the button section 2 to the point B that is of the on point fall within about 3 degrees.

However, in order to decrease the rotation angle θ without changing the stroke amount, it is necessary to lengthen the line segment AC and the line segment BC. Therefore, it is necessary to largely separate the point C from the switch main body 1, which enlarges a space necessary to install the switch SW'. The click feeling is hardly improved in the case that the point C cannot be set to the position satisfying the condition that the rotation angle θ falls within about 3 degrees in the space allocated to the installation of the switch SW'.

On the other hand, in the push button switch SW having the configuration in FIG. 1, the points A, B, and C are previously determined, and the angle θ and the inclination angle ϕ of the bottom surface 2M of the button section 2 can be determined so as to adapt to the points A, B, and C. Therefore, even if the installation space of the switch SW is restricted, the point C is determined in the installation space, and the switch SW can be installed by adjusting the angles θ and ϕ. For example, in the case that it is necessary to bring the point C close to the switch main body 1 compared with the example in FIG. 1 due to the small installation space, the point C is set lower to obtain the angle θ, and the inclination angle ϕ of the bottom surface 2M of the button section 2 is determined according to the value of the angle θ.

Accordingly, the push button switch SW having the configuration in FIG. 1 can easily be introduced to the compact apparatus.

In the example in FIG. 1, the place (the point C) where the support arm 3 is attached is set to the position that is located obliquely below the moving range of the upper surface of the movable section 10. Alternatively, the point C may be set to the side of the moving range of the upper surface of the movable section 10.

In the example in FIG. 1, the background portion in the drawings is used as the board surface, the rear surface of the switch main body 1 is fixed to the board surface, the support arm 3 extends in the lateral direction of the switch main body 1, and the support arm 3 is attached to the identical board surface. However, the orientation and the attachment position of the support arm 3 are not limited to the example in FIG. 1.

For example, when the low-profile switch main body 1 is formed, after the support arm 3 is extended to a front side of the switch main body 1, the support arm 3 can be conducted to the position obliquely below the switch main body 1, and attached to the board.

An example of an electronic apparatus in which the push button switch having the configuration is disposed will be described below.

Figure 4:
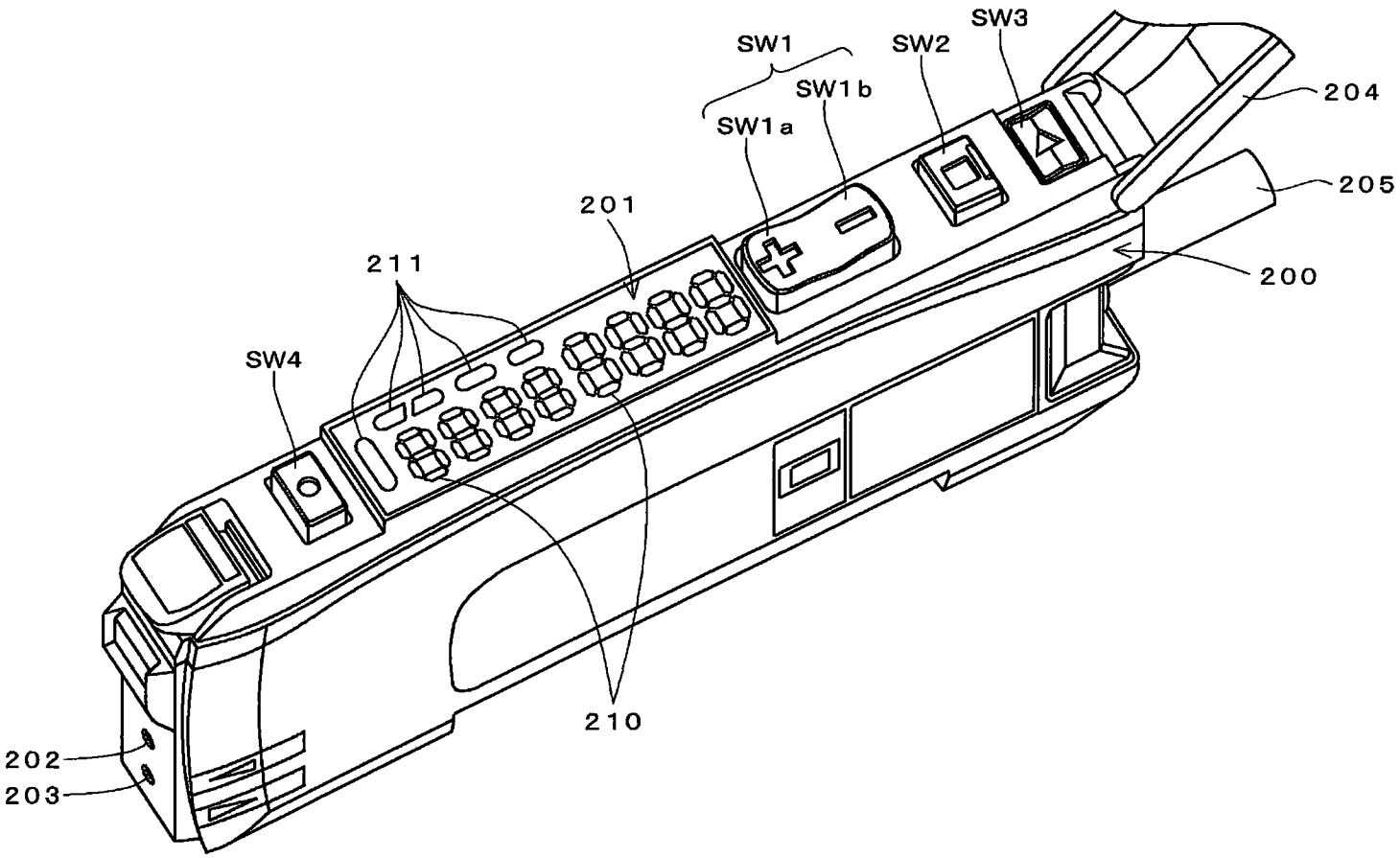
FIG. 4 is a perspective view illustrating an appearance of a photoelectric sensor to which the push button switch according to the present invention is introduced.
Figure 5:
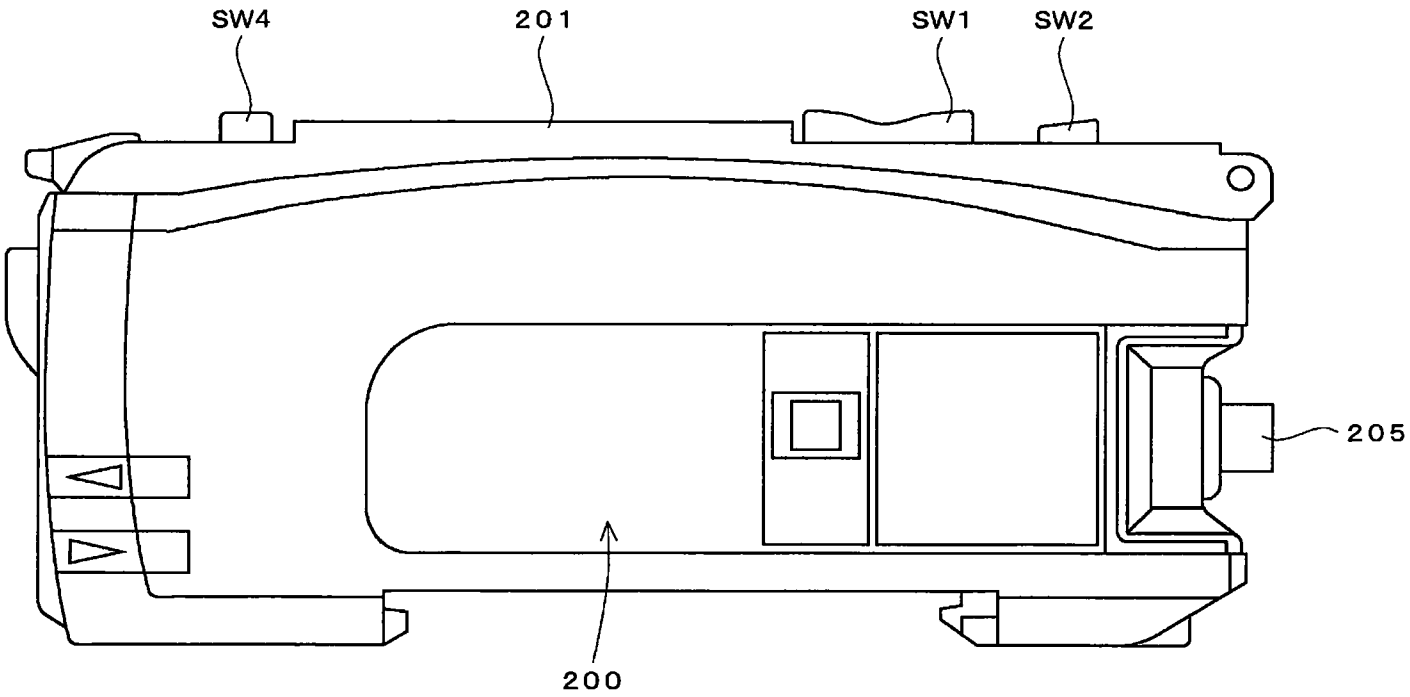
FIG. 5 is a side view of the photoelectric sensor.

FIGS. 4 and 5 illustrate an appearance of a photoelectric sensor to which the push button switch of the present invention is introduced.

The photoelectric sensor has the configuration in which a display section 201 and a plurality of push button switches SW1 to SW4 are disposed on an upper surface of a narrow casing 200. Usually the upper surface is covered with a cover 204, and the cover 204 can be opened to operate the push button switches SW1 to SW4 during the setting.

The photoelectric sensor is one in which light projection and light reception are performed using an optical fiber. Insertion ports 202 and 203 are provided in the front surface of the casing 200 in order to insert the light projection and light reception optical fibers (not illustrated). A connection cable 205 is extracted from the rear surface of the casing 200. A light projection section (not illustrated) including a light emitting element and a light reception section (not illustrated) including a light reception element are provided in the casing 200, and a board 60 is also disposed in the standing posture in the casing 200.

A plurality of indicators 210 (each of which indicates a numerical character or an alphabet) constructed by 7-segment LEDs and a plurality of indicating lamps 211 are provided in the display section 201. The single push button switch SW4 is disposed in front of the display section 201, and the three push button switches SW1, SW2, and SW3 are disposed at the back of the display section 201. Two switches SW1*a* and SW1*b* are included in the push button switch SW1 provided closest to the display section 201.

Figure 6:
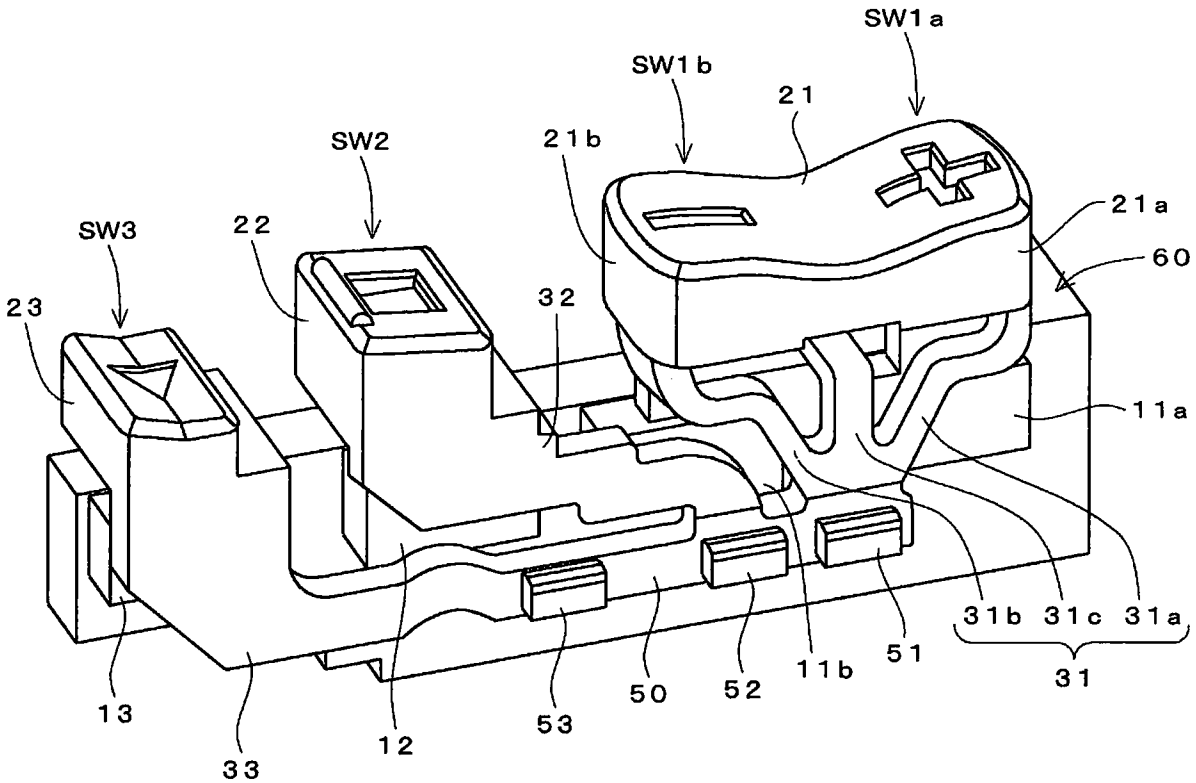
FIG. 6 is a perspective view illustrating a detailed configuration of push button switches SW1*a*, SW1*b*, SW2, and SW3.
Figure 7:
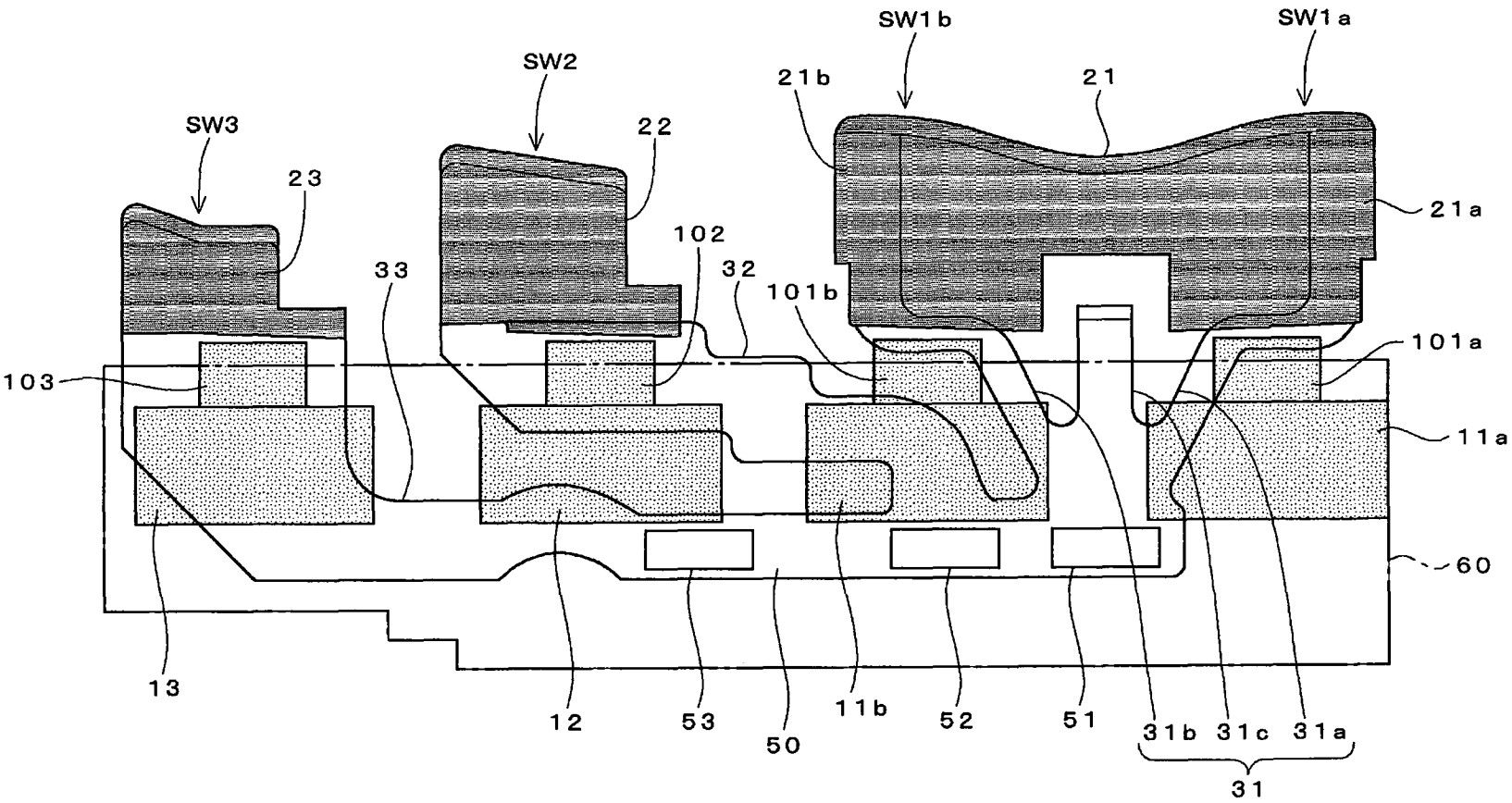
FIG. 7 is a view illustrating a relationship between switch main bodies of the push button switches SW1*a*, SW1*b*, SW2, and SW3 and button sections.
Figure 8:
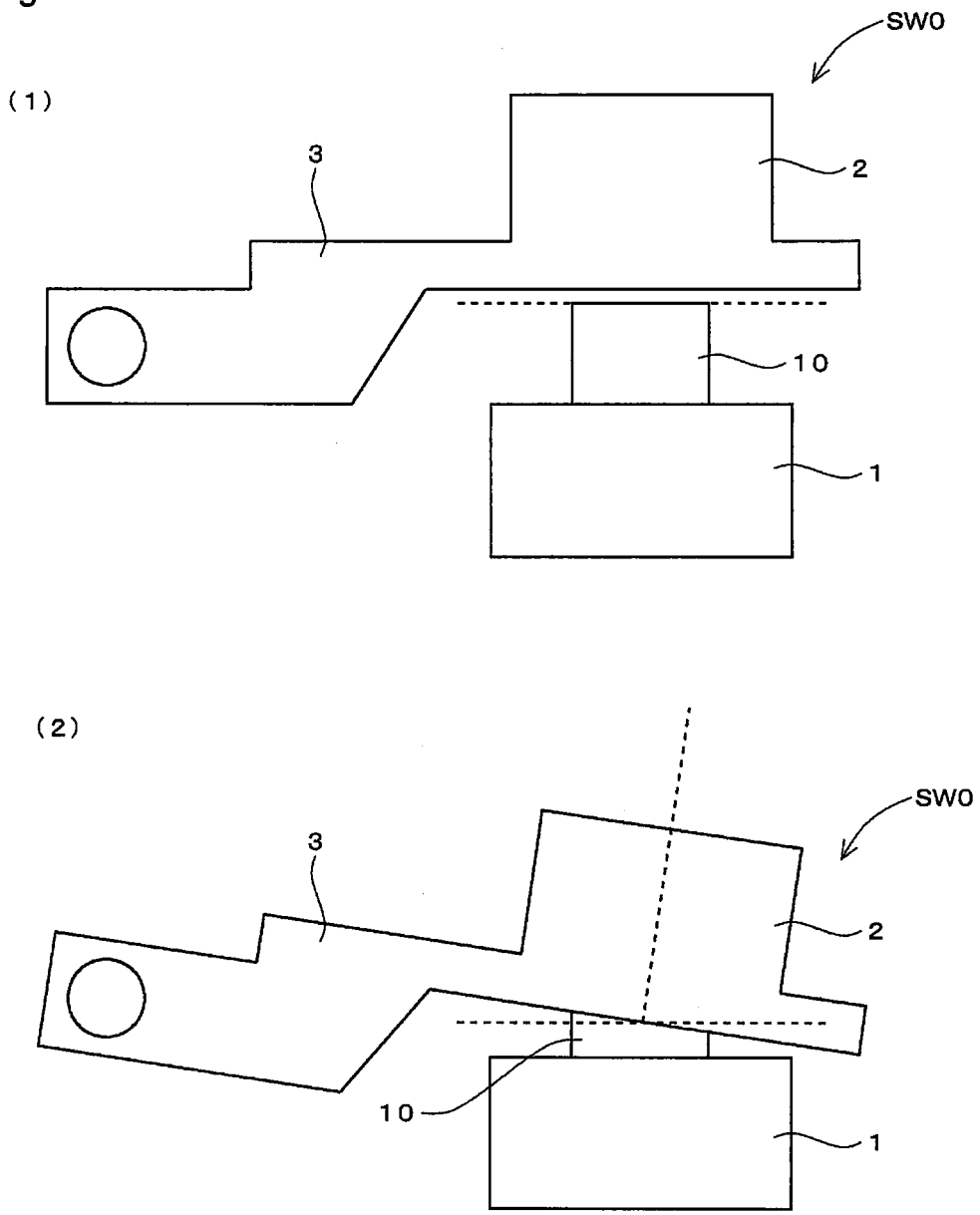
FIG. 8 is a schematic view illustrating a configuration of a conventional push button switch.
Figure 9:
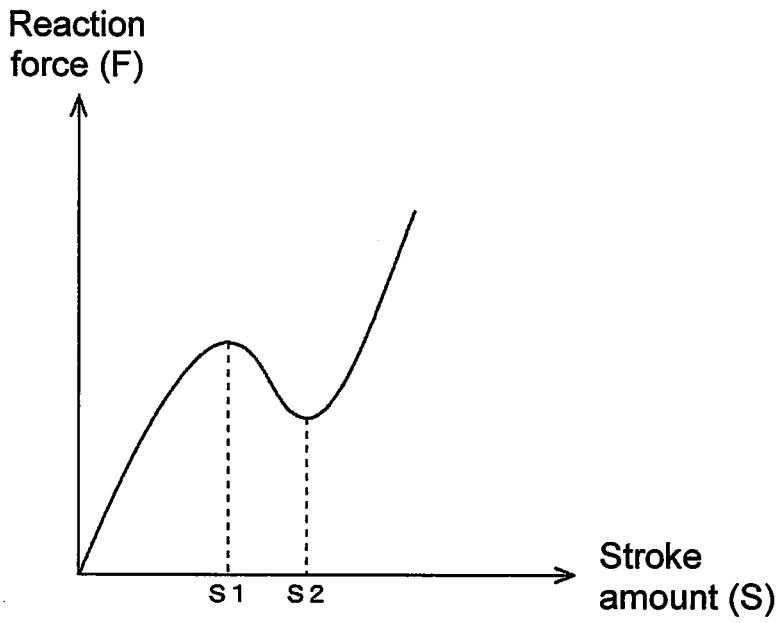
FIG. 9 is a graph illustrating a relationship between a reaction force F generated by a pressure of a movable section and a stroke amount S.

The present invention is applied to the two-type switches SW1*a* and SW1*b* and the switches SW2 and SW3. FIGS. 6 and 7 illustrate detailed configurations of the switches SW1*a*, SW1*b*, SW2, and SW3. FIGS. 6 and 7 illustrate the switches SW1*a*, SW1*b*, SW2, and SW3 while the opposite side to that in FIG. 5 is adopted as the front side. In the following description, the surface located front in FIGS. 6 and 7 is adopted as the front surface.

In the example in FIGS. 6 and 7, the switches SW1*a*, SW1*b*, SW2, and SW3 include switch main bodies 11*a*, 11*b*, 12, and 13 and movable sections 101*a*, 101*b*, 102, and 103, respectively. The switch main bodies 11*a*, 11*b*, 12, and 13 are fixed to one of the surfaces of the board 60, which is disposed in the standing state, at predetermined intervals.

The button sections 21*a* and 21*b* of the switches SW1*a* and SW1*b* are integrated as one member 21. A three-branch type support arm 31 (the branches are referred to as support arms 31*a*, 31*b*, and 31*c*) is coupled to a lower end portion on the front side of the member 21. The support arm 31*a* supports the button section 21*a*, the support arm 31*b* supports the button section 21*b*, and the support arm 31*c* supports a coupling portion (center portion of the member 21) of the button sections 21*a* and 21*b*.

In each of the button sections 22 and 23 of the switches SW2 and SW3, the support arms 32 and 33 are integrally provided in the lower portion of the front surface. The support arms 32 and 33 extend in an obliquely right downward direction (the front side of the casing 200), and is connected to a base section 50 that extends along the horizontal direction. The three-branch type support arm 31 coupled to the member 21 is also connected to the base section 50. Therefore, the button sections 21*a*, 21*b*, 22, and 23 and the support arms 31, 32, and 33 are coupled to each other to form a button unit.

Three rectangular holes (not illustrated) are made in the base section 50, and projection members 51, 52, and 53 provided on the side of the board 60 is fitted in the holes to attach the support arms 31, 32, and 33 to the board 60

The support arm 31*a* and 31*b* connected to the button section 21*a* and 21*b* of the switches SW1*a* and SW1*b* are turnably supported while the projection member 51 immediately below the support arm 31*c* between the support arm 31*a* and 31*b* is used as a common support section. The support arm 32 connected to the button section 22 of the switch SW2 is turnably supported by the projection member 52, and the support arm 33 of the switch SW3 is turnably supported by the projection member 53. That is, each support arm is turnably supported at the position located obliquely below the moving range of the movable section of the corresponding switch main body.

In FIG. 7, a relationship between the button sections 21*a*, 21*b*, 22, and 23 of the switches SW1*a*, SW1*b*, SW2, and SW3 and the switch main bodies 11*a*, 11*b*, 12, and 13 and the movable sections 101*a*, 101*b*, 102, and 103 are explicitly illustrated by adding a halftone dot pattern to the both. The button sections 21*a*, 21*b*, 22, and 23 that are not subjected to the downward pressing operation are supported while slight gaps are ensured between the button sections 21*a*, 21*b*, 22, and 23 and the corresponding movable sections 101*a*, 101*b*, 102, and 103. The bottom surfaces of the button sections 21*a*, 21*b*, 22, and 23 incline so as to be displaced obliquely upward from the side close to the projection members 51, 52, and 53 stopping the corresponding support arms 31*a*, 31*b*, 32, and 33 toward the opposite side.

When one of the button sections 21*a*, 21*b*, 22, and 23 of the switches SW1*a*, SW1*b*, SW2, and SW3 is pressed downward, the support arm and the button section rotate about the support position of the support arm coupled to the downwardly-pressed button section to press the movable section of the corresponding switch main bodies. When the downwardly-pressed movable section lowers to the on point, the movable contact and the fixed contact come into contact with each other to establish a conduction state, and an electric signal is input to a control circuit (not illustrated) by the conduction state. In each of the switches SW1*a*, SW1*b*, SW2, and SW3, the inclination angle of the bottom surface is set such that the inclination of the bottom surface falls within the angle difference of 3 degrees or less with respect to the horizontal direction when the bottom surface of the button sections 21*a*, 21*b*, 22, and 23 press the movable sections 101*a*, 101*b*, 102, and 103 to the neighborhood of the on point.

Specifically, the inclination angle of the bottom surface of each of the button sections 21*a*, 21*b*, 22, and 23 of the embodiment is set in the range of 1.5 to 2.5 degrees. However, the inclination angle is not limited to the range of 1.5 to 2.5 degrees, but the inclination angle fluctuates depending on the space used to install the switch and the like.

In each of the switches SW1*a*, SW1*b*, SW2, and SW3, the movable sections 101*a*, 101*b*, 102, and 103 passing through the on point can be pressed from the substantially perpendicular direction by adjusting the inclination angles of the button sections 21*a*, 21*b*, 22, and 23, and the sufficient click feeling can be provided to the user who performs the downward pressing operation.

Depending on the design, the projection member fixing the support arm can be provided in not the board 60, but in the front surface of the switch main body or an inner wall surface of the casing. Similarly the switch main body can be attached to the support surface except the board, for example, the inner wall surface of the casing.

Although the detailed description is not given, the configuration similar to each of the switches SW1*a*, SW1*b*, SW2, and SW3 can be adapted to the push button switch SW4 disposed in the front portion of the casing 200. The control circuit that receives the signal from each of the switches SW1*a*, SW1*b*, SW2, and SW3 can be mounted in front of or below the range where the switch is disposed in the board 60 or on the surface on the opposite side to the switch.

DESCRIPTION OF SYMBOLS

SW, SW1*a*, SW1*b*, SW2, SW3 push button switch
1, 11*a*, 11*b*, 12, 13 switch main body
2, 21*a*, 21*b*, 22, 23 button section
3, 31*a*, 31*b*, 32, 33 support arm
10, 101*a*, 101*b*, 102, 103 movable section
2M bottom surface of button section
51, 52, 53 fixing member
60 board

The invention claimed is:

1. A push button switch comprising:

a switch main body comprising a movable section configured to be displaced downward by a pressure to bring a movable contact into contact with a fixed contact, the movable section being configured to be displaced upward to open each contact by a release of the pressure;

a button section configured to press an upper surface of the movable section in response to a downward pressing operation; and a support arm in which one of end portions is coupled to the button section, and the other end portion is attached to a support surface provided along a vertical direction such that the support arm is turnable, the support arm supporting the button section that is not subjected to the downward pressing operation so as to separate the button section from the movable section, wherein the end portion of the support arm in the side not coupled to the button section is attached to the support surface while positioned laterally or obliquely downward with respect to a moving range of an upper surface of the movable section, and an inclination angle of a bottom surface of the button section is set such that the bottom surface constitutes an inclination surface while being not subjected to the downward pressing operation and when the bottom surface of the button section contacts the upper surface of the movable section prior to the movable contact being brought into contact with the fixed contact, and such that the bottom surface becomes substantially horizontal when the movable section is pressed to a position where the movable contact and the fixed contact are brought into contact with each other.

2. A push button switch comprising:

a switch main body comprising a movable section configured to be displaced downward by a pressure to bring a movable contact into contact with a fixed contact, the movable section being configured to be displaced upward to open each contact by a release of the pressure;

a button section configured to press an upper surface of the movable section in response to a downward pressing operation; and a support arm in which one of end portions is coupled to a button section, and the other end portion is attached to a support surface provided along a vertical direction such that the support arm is turnable, the support arm supporting the button section that is not subjected to the downward pressing operation so as to separate the button section from the movable section, wherein the end portion of the support arm in the side not coupled to the button section is attached to the support surface while positioned laterally or obliquely downward with respect to a moving range of an upper surface of the movable section, and an inclination angle of a bottom surface of the button section is set such that the bottom surface constitutes an inclination surface while being not subjected to the downward pressing operation, and such that the bottom surface becomes substantially horizontal when the movable section is pressed to a position where the movable contact and the fixed contact are brought into contact with each other, wherein the inclination angle of the bottom surface of the button section is set so as to be an angle that falls within a predetermined error range with respect to an angle θ that is formed between a straight line connecting a center of the upper surface of the movable section that lowers to the position where the movable contact and the fixed contact are brought into contact with each other and a position that constitutes a rotation axis of the support arm and a straight line connecting a center of the bottom surface of the button section that is not subjected to the downward pressing operation and the position that constitutes the rotation axis of the support arm.

3. The push button switch according to claim 2, wherein the inclination angle of the bottom surface of the button section is set to the error range between −3 degrees to +3 degrees with respect to the angle θ.

4. An electronic apparatus, wherein a push button switch comprises:

a switch main body comprising a movable section configured to be displaced downward by a pressure to bring a movable contact into contact with a fixed contact, the movable section being configured to be displaced upward to open each contact by a release of the pressure;

a button section configured to press the movable section in response to a downward pressing operation; and a support arm in which one of end portions is coupled to the button section, and the other end portion is attached to a support surface provided along a vertical direction such that the support arm is turnable, the support arm supporting the button section that is not subjected to the downward pressing operation so as to separate the button section from the movable section, the push button switch is disposed while the button section is exposed from a surface of a casing, and the support arm and one surface except an upper surface and a bottom surface of the switch main body are attached to the support surface in the casing, the end portion of the support arm in the side not coupled to the button section is attached to the support surface while positioned laterally or obliquely downward with respect to a moving range of an upper surface of the movable section, and an inclination angle of a bottom surface of the button section is set such that the bottom surface constitutes an inclination surface while being not subjected to the downward pressing operation and when the bottom surface of the button section contacts the upper surface of the movable section prior to the movable contact being brought into contact with the fixed contact, and such that the bottom surface becomes substantially horizontal when the movable section is pressed to a position where the movable contact and the fixed contact are brought into contact with each other.

5. The electronic apparatus according to claim 4, wherein the inclination angle of the bottom surface of the button section is set so as to be an angle that falls within a predetermined error range with respect to an angle θ that is formed between a straight line connecting a center of the upper surface of the movable section that lowers to the position where the movable contact and the fixed contact are brought into contact with each other and a position that constitutes a rotation axis of the support arm and a straight line connecting a center of the bottom surface of the button section that is not subjected to the downward pressing operation and the position that constitutes the rotation axis of the support arm.

6. The electronic apparatus according to claim 5, wherein the inclination angle of the bottom surface of the button section is set to the error range between −3 degrees to +3 degrees with respect to the angle θ.

* * * * *